United States Patent [19]

Niven

[11] Patent Number: 5,014,949

[45] Date of Patent: May 14, 1991

[54] PRODUCT DISPENSER

[75] Inventor: Mark A. Niven, Yonkers, N.Y.

[73] Assignee: Goldring Display Group, Inc., Paramus, N.J.

[21] Appl. No.: 539,928

[22] Filed: Jun. 18, 1990

[51] Int. Cl.[5] ..... A47F 7/00

[52] U.S. Cl. ..... 248/220.4; 248/221.1; 211/59.1; 211/57.1

[58] Field of Search ..... 248/220.4, 220.3, 221.1; 211/59.1, 57.1, 54.1

[56] References Cited

U.S. PATENT DOCUMENTS 3,266,072 12/1965 Johnson ..... 248/221.1
4,616,753 10/1986 Aslan ..... 248/220.4 X

FOREIGN PATENT DOCUMENTS 2325386 12/1973 Fed. Rep. of Germany ... 248/220.4
2715396 10/1978 Fed. Rep. of Germany ... 248/220.4
1114701 9/1965 United Kingdom ..... 248/221.2

*Primary Examiner*—Carl D. Friedman
*Assistant Examiner*—Sarah Lechok
*Attorney, Agent, or Firm*—Anthony F. Cuoco

[57] ABSTRACT

Cards of the type having products encapsulated thereon are supported on a dispenser. A mounting section mounts the dispenser to a mounting surface and the cards are supported on a supporting section of the dispenser via engagement thereof by an aperture in the cards. A connecting section of the dispenser extends from the supporting section to the dispensing section and is shaped so that the dispensing section extends outwardly from and above the supporting section. The geometry of the connecting section and the position of the aperture are such that the product card must be discreetly manipulated from the supporting section to the dispensing section via the connecting section for removal from the dispenser, whereby unauthorized removal or pilfering of product cards from the dispenser is inhibited, as is malicious removal or inadvertent displacement of the cards therefrom.

3 Claims, 2 Drawing Sheets

PRODUCT DISPENSER

CROSS REFERENCE TO RELATED APPLICATIONS

This application is related to U.S. design patent application Ser. No. 522,852 filed by the present inventor on May 14, 1990.

BACKGROUND OF THE INVENTION

A variety of products, such as electronic appliance batteries, bolts, hooks and other such hardware products are packaged by encapsulating the products on cards whereby the familiar "blister" or "bubble" product cards are formed. Modern merchandising techniques require these cards to be supported on dispensers mounted on perforated (peg) boards, slat walls or other like mounting surfaces. The dispensers are generally unattended for self-service merchandising.

Problems exist in that under the above described circumstances, the product cards can be easily removed, either maliciously or inadvertently, from heretofore available dispensers. In this regard, reference is made to a catalogue published by Trion Industries, Inc., 297 Laird Street, WilkesBarre, Pa. 18702 which illustrates and describes a variety of prior art dispensers which have been used for the purposes described. It will be readily discerned that, while these prior art dispensers serve to adequately support the aforementioned product cards, they do not address the above identified problems.

The dispensers herein disclosed are configured so as to require discrete manipulation to remove the product cards therefrom and therefore avoid the problems associated with the prior art dispensers. The configuration is such that unauthorized removal of the product cards from the dispensers, as by pilferers or the like, is impeded. Further, malicious removal of the product cards from the dispensers as by vandals or the like, and even inadvertent displacement of the cards from the dispensers as by a passerby brushing against the dispensers, is impeded. All in all, the product dispenser of the present invention avoids the problems occasioned by the prior art dispensers and enhances self-service merchandising of the products involved.

SUMMARY OF THE INVENTION

This invention contemplates a product dispenser of the type for dispensing products which are encapsulated on cards. The cards have apertures near the top edge thereof which engage the dispenser for supporting the cards thereon. The dispenser has a mounting section for supporting the dispenser on a mounting surface, an elongated card supporting section extending outwardly from the mounting section for supporting a plurality of product cards and an elongated dispensing section extending outwardly from and above the supporting section. A connecting section is in geometrically shaped relation to the location of the apertures in the cards and extends from the supporting section to the dispensing section. The configuration is such that cards must be discretely manipulated for removal from the dispenser. The arrangement described impedes covert removal of the cards from the dispenser as by pilferers or the like, and likewise inhibits malicious removal or accidental displacement of the cards therefrom, as may otherwise occur.

DETAILED DESCRIPTION OF THE INVENTION

Figure 1:
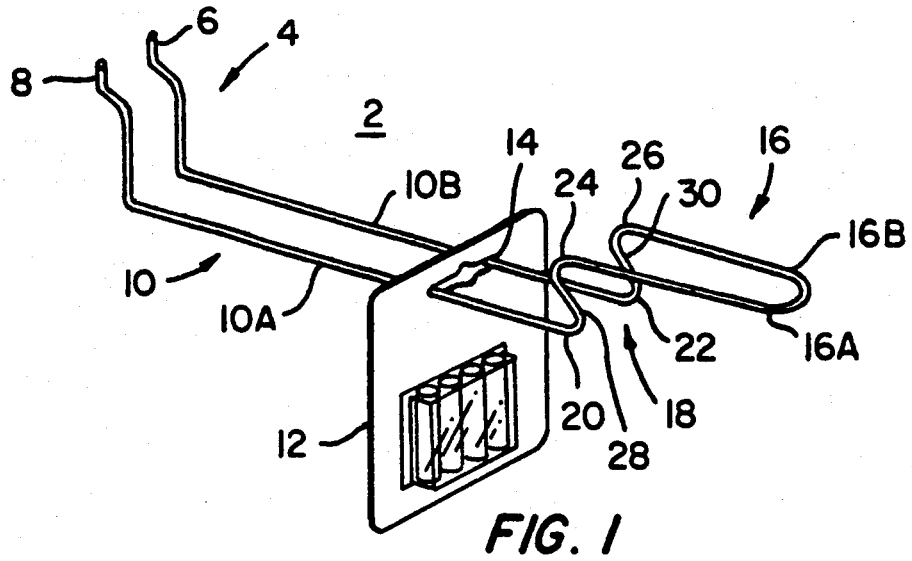
FIG. 1 is a perspective view illustrating one form of the invention wherein the product dispenser is of double wire form and includes a mounting section for mounting the dispenser on a perforated (peg) board.

With reference to FIG. 1, a product dispenser according to the invention is designated generally by the numeral 2. Product dispenser 2 is of a double wire form. That is to say, the dispenser is formed from a continuous length of wire bent or otherwise formed to provide two substantially parallel members.

Dispenser 2 has a mounting section 4 including a pair of substantially parallel hooks 6 and 8 which fit into the holes of a peg board or the like for mounting the dispenser thereto. An elongated card supporting section 10 having arms 10A and 10B extends outwardly from mounting section 4 and substantially normal thereto, and supports a plurality of product cards 12, only one of which product cards is shown in the Figure for purposes of illustration. Product cards 12 have an aperture 14 near the center of the top edge thereof which engages supporting section 10 for supporting the product cards thereon.

An elongated dispensing section 16 having arms 16A and 16B extends outwardly from supporting section 10 and substantially parallel thereto. A connecting section 18 extends outwardly from supporting section 10 to dispensing section 16 so that the dispensing section is above the supporting section.

Connecting section 18 is substantially S-shaped and has a lower outwardly extending arcuate portion 20 extending from arm 10A of supporting section 10 and another lower outwardly extending arcuate portion 22 extending from arm 10B thereof. Connecting section 18 has an upper inwardly extending arcuate portion 24 and another upper inwardly extending arcuate portion 26. Arcuate portions 24 and 26 join arcuate portions 20 and 22, respectively, via members 28 and 30, respectively, and extend to arms 16A and 16B, respectively, of dispensing section 16.

The arrangement is such that cards 12 supported on supporting section 10 as shown and described must be discretely manipulated from supporting section 10 to dispensing section 16 via connecting section 18 so as to be removed from dispenser 2, as will be hereinafter more fully explained. It will become evident that the arrangement described impedes unauthorized removal or pilfering of the product cards from the dispenser and likewise impedes malicious or inadvertent removal, as is otherwise likely to occur.

Figure 2:
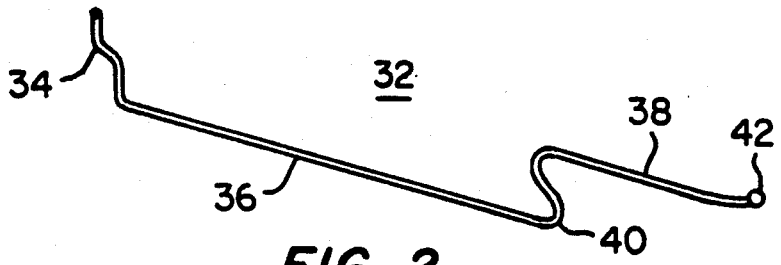
FIG. 2 is a perspective view illustrating another form of the invention wherein the product dispenser is of single wire form and includes another form of peg board mounting section.

FIG. 2 shows a form of the invention wherein a product dispenser 32 is formed from a single wire which is bent or otherwise formed in the illustrated configuration. Dispenser 32 includes a mounting section 34 which, like mounting section 4, fits into a peg board or the like and includes a card supporting section 36. A dispensing section 38 is connected to supporting section 36 via a substantially S-shaped connecting section 40. The outward end of dispensing section 38 carries a retaining ball or the like 42. In this regard, it will be understood that product cards used in conjunction with dispenser 32 have apertures which are circular holes (not otherwise shown) rather than slot-like as shown in FIG. 1. The obvious purpose of ball 42 is to retain the product card on the dispensing section of the dispenser in the absence of at least some effort to remove the card therefrom.

Figure 3:
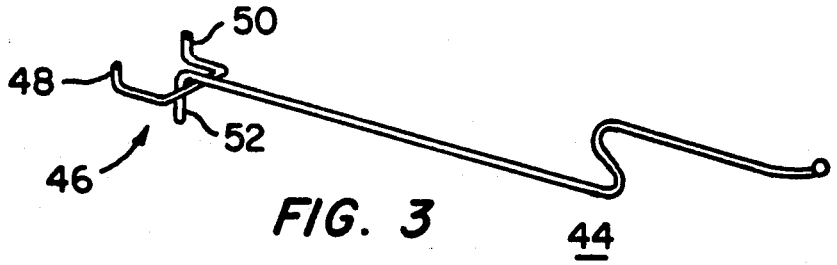
FIG. 3 is a perspective view of still another form of the invention similar to that shown in FIG. 1 but including another form of peg board mounting section.

The form of the invention shown in FIG. 3 features a product dispenser designated by the numeral 44 and is in most respects similar to that shown in FIG. 2, except that mounting section 46 thereof has a pair of hooks 48 and 50 for fitting into a peg board or the like, and has a stabilizing member 52 extending in a direction opposite to that of hooks 48 and 50.

Figure 4:
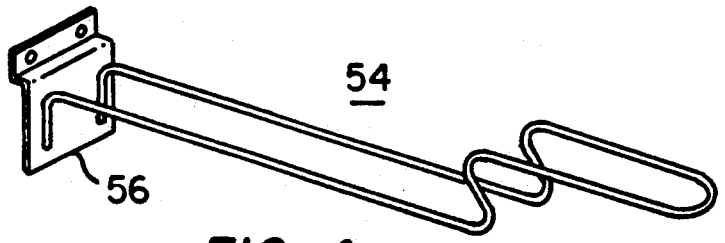
FIG. 4 is a perspective view of yet another form of the invention similar to that shown in FIG. 1 but showing a form of mounting section for slat wall mounting.

The form of the invention shown in FIG. 4 is in most respects similar to that shown in FIG. 1 except that mounting section 56 thereof is of the slat wall type. That is to say, mounting section 56 mounts dispenser 54 onto a slat wall type supporting surface as will be readily understood.

Figure 5:
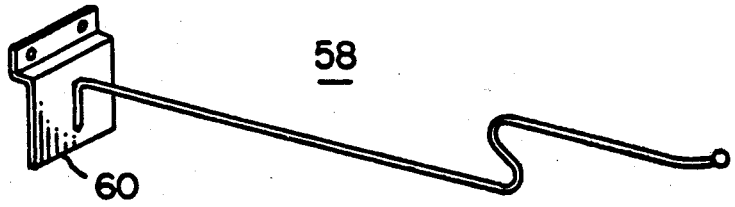
FIG. 5 is a form of the invention similar to the forms shown in FIGS. 2 and 3 but showing a form of mounting section for slat wall mounting.

The form of the invention shown in FIG. 5 features a dispenser 58 which is in most respects similar to dispensers 32 and 44 shown in FIGS. 2 and 3, respectively, except that mounting section 60 thereof is of the slat wall type shown in FIG. 4.

Figure 6:
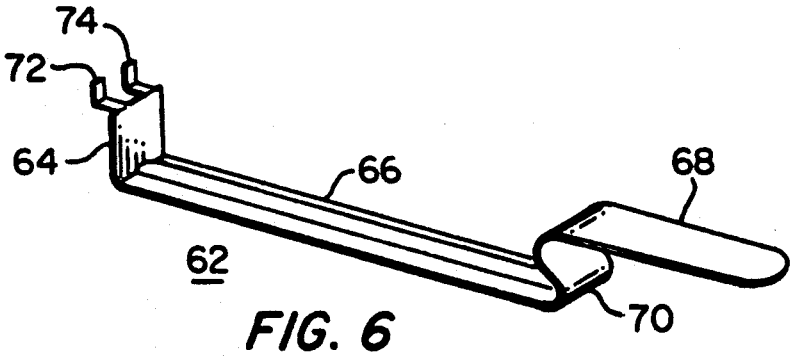
FIG. 6 is a form of the invention wherein the product dispenser is of flat form and includes another form of peg board mounting section.

The form of the invention shown in FIG. 6 features a product dispenser designated by the numeral 62. Product dispenser 62 is formed of flat stock so as to have a mounting section 64, a supporting section 66, a dispensing section 68 and a substantially S-shaped connecting section 70. The relationship and purposes of the supporting, dispensing and connecting sections are the same as heretofore described with reference to FIGS. 1–5. Mounting section 64 has a pair of hooks or prongs 72 or 74 for fitting into a peg board mounting surface or the like.

It will be recognized that the forms of the invention shown in FIGS. 1–6 all feature a substantially S-shaped connecting section which extends from the supporting section of the dispenser to the dispensing section thereof, whereby the dispensing section extends outwardly from and above the supporting section. The geometric configuration of the S-shaped section is related to the location of the aperture on product cards 12 so that the product cards must be discretely manipulated to displace the cards from the supporting section to the dispensing section of the dispensers for removal therefrom.

Figure 7:
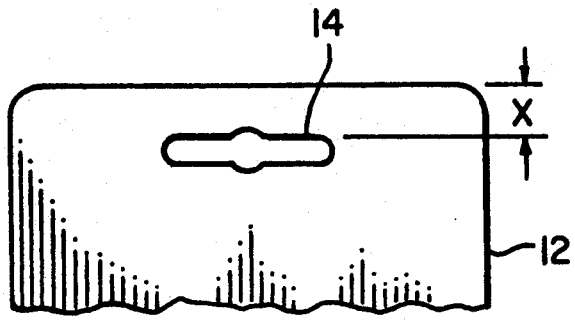
FIG. 7 is a partial plan view of a product card of the type supported by the dispenser of the invention and illustrating a particular dimensional characteristic of an aperture therein which engages a supporting section of the dispenser.
Figure 8:
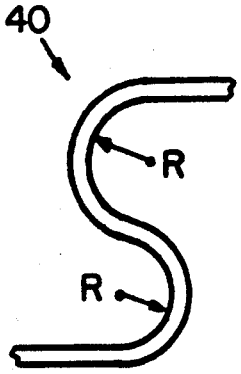
FIG. 8 is a diagrammatic representation illustrating the geometric form of a connecting section of the dispenser of the invention.

In further explanation of this feature of the invention, reference is made to FIGS. 7 and 8. In FIG. 7, the distance from the top of card 12 to the top of aperture 14 is designated as X.

With reference to FIG. 8, a diagrammatic representation of the several S-shaped connecting sections is shown, with S-shaped connecting section 40 being specifically shown for purposes of illustration. Thus, the upper and lower arcuate portions of S-shaped section 40 have substantially equal radii designated as R. The geometric relationship between distance X and radii R is that radii R are substantially equal to distance X, i.e. R =X. When cards 12 are of the type used with the forms of the invention shown in FIGS. 2, 3 and 5, aperture 14 is actually a circular hole as aforenoted and distance X is the distance from the top of the card to the top of the hole with the same geometrical relationship existing between distance X and radii R.

With the arrangement shown and described, casual removal of cards 12 from the several product card dispensers is impeded and the cards must be discretely maneuvered to be displaced from the supporting section of the dispenser to the dispensing section thereof for removal. That is to say, the cards must be discretely displaced along the lower arcuate portion of the substantially S-shaped connecting member and then likewise discretely displaced along the upper arcuate portion thereof. The aforenoted relationship between distance X and radii R is a contributing factor in this regard, as is the position of the several dispensing members relative to the several supporting members, i.e. the dispensing members extending outwardly from and above the supporting members.

All in all, the dispenser configurations shown and described make removal of the product cards from the dispenser at least a deliberate act so as to inhibit a pilferer, for example, from lingering near a product display long enough to remove perhaps more than one product card from the dispenser. Likewise, malicious removal of the product cards from the dispenser, as by vandals or the like, is inhibited. Further, inadvertent brushing or touching of the dispenser will not result in the product card falling therefrom, as has heretofore been the case. In this regard, it will be understood that while removal of the product cards is impeded, refilling of the dispensers with product cards can be accomplished with relative ease. It will be observed that the upward and outward extension of the dispensing section from the supporting section via the S-shaped connecting section configured as indicated impedes quick removal of the cards from the dispenser but does not impede quick refill, as is desireable. In this regard, it is noted that interference occurs between the product card and the dispensing section upon removal but does not occur upon replacement of the cards.

The invention may be produced as a single part from a single material or as a combination of parts and materials to satisfy the purposes required. The dispensers may be mounted as multiple units or ganged together as will be readily understood. The material of the dispensers may be metal or plastic wire, flat metal or plastic, or any combination thereof and the dispensers may be manufactured by conventional methods such as, for purposes of example, hand fabrication, semi-automatic and fully automatic metal forming techniques, injection molding and other like methods.

With the above description of the invention in mind, reference is made to the claims appended hereto for a definition of the scope of the invention.

What is claimed is:

1. A dispenser for products encapsulated in product cards of the type having apertures near the tops thereof, the dispenser comprising:

a mounting section for mounting the dispenser to a mounting surface;

an elongated supporting section extending outwardly from the mounting section substantially normal to the mounting surface for supporting the product cards when the apertures in the cards engage the supporting section;

an elongated dispensing section;

a substantially S-shaped connecting section having a first outwardly extending arcuate portion extending from the supporting section and a second inwardly extending arcuate portion extending to the dispensing section, said second arcuate portion being above said first arcuate portion so that the elongated dispensing section extends outwardly from and above the elongated supporting section; and the cards requiring discrete manipulation from the supporting section to the dispensing section along the substantially S-shaped connecting section, with removal of the cards from the dispenser being thereby impeded.

2. A dispenser as described in claim 1, wherein:

the outwardly extending arcuate portion has a first radius;

the inwardly extending arcuate portion has a second radius; and said first and second radii are substantially equal.

3. A dispenser as described by claim 2, wherein:

the first and second radii are substantially equal to the distance from the tops of the cards to the tops of the apertures.

* * * * *